US005435514A

United States Patent [19]

Kerr, Jr.

[11] Patent Number: 5,435,514

[45] Date of Patent: Jul. 25, 1995

[54] FAN HANGER SUPPORT FOR DROP CEILINGS

[75] Inventor: Jack R. Kerr, Jr., College Station, Tex.

[73] Assignee: Fan Tex, Inc., College Station, Tex.

[21] Appl. No.: 231,589

[22] Filed: Apr. 20, 1994

Related U.S. Application Data

[63] Continuation of Ser. No. 897,915, Jun. 12, 1992, abandoned.

[51] Int. Cl.[6] ..... F16M 13/00

[52] U.S. Cl. ..... 248/343; 248/906; 248/205.1

[58] Field of Search ..... 248/328, 327, 317, 343, 248/344, 342, 205.1, 906; 220/3.9, 3.2; 174/63

[56] References Cited

U.S. PATENT DOCUMENTS

| | | | |
|---|---|---|---|
| 2,060,046 | 11/1936 | di Giacomo | 248/327 X |
| 3,589,660 | 5/1971 | Dunckel | 248/343 |
| 3,597,889 | 3/1971 | Lo Nigro | 52/28 |
| 4,041,657 | 2/1977 | Schuplin | 52/39 |
| 4,114,326 | 12/1978 | Macuga et al. | 52/28 |
| 4,114,327 | 11/1978 | Williams | 52/28 |
| 4,126,971 | 9/1978 | Macuga et al. | 52/28 |
| 4,463,923 | 8/1984 | Reiker | 248/906 X |
| 4,684,092 | 8/1987 | Reiker | 248/343 X |
| 4,892,311 | 1/1990 | Jorgensen | 248/343 X |
| 4,909,405 | 7/1990 | Kerr, Jr. | 220/3.9 |
| 4,988,067 | 1/1991 | Propp et al. | 248/906 X |
| 5,085,393 | 2/1992 | Ryan | 248/343 |

OTHER PUBLICATIONS

Eclipse Mfg. Inc—Quick Drop Fan Hanger Brochure.

*Primary Examiner*—Karen J. Chotkowski

*Attorney, Agent, or Firm*—Daniel Rubin

[57] ABSTRACT

A hanger assembly for supporting a vertical load at a selected site flush mounted beneath the underside of a drop ceiling. Comprising the assembly is a pair of bars normally intersecting in T formation and mounted onto the T rails of a lattice framework supporting the individual ceiling panel at the selected site. The bars can be variably positioned so as to intersect at any selected site location and by means of a bracket are permanently secured together with a junction box at the underside of the intersection. The bracket in turn is connected for static loading to a depending chain attached to the building structure above the ceiling and adjustably rendered taut to a predetermined tension by means of a turnbuckle attachment. For supporting an attached load, the load bolts have flat heads with canted ends and depend through apertures in both the top wall and ears of the junction box. The bolt heads cooperate with the junction box so as to prevent both rotational and upward displacement when a load to be supported is being installed.

20 Claims, 3 Drawing Sheets

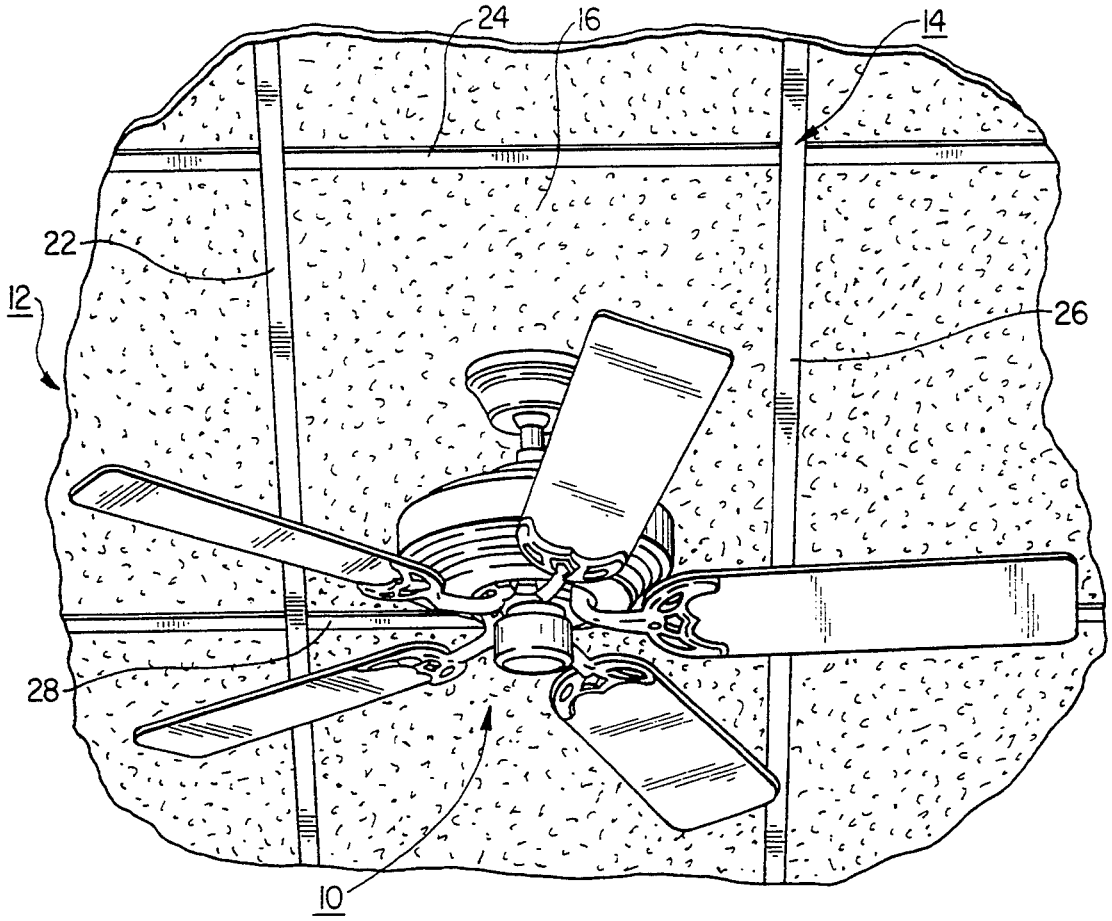
FIG. 1
FIG. 6
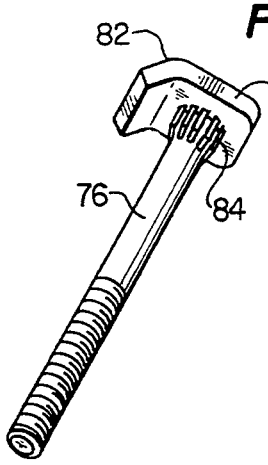
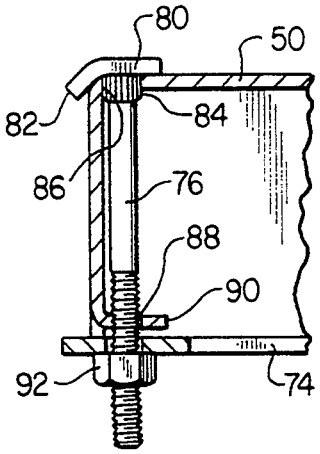
FIG. 7
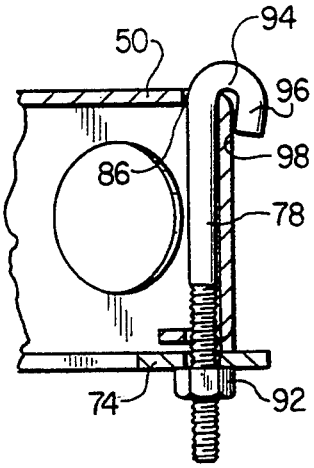
FIG. 8

FAN HANGER SUPPORT FOR DROP CEILINGS

This application is a continuation of application Ser. No. 07/897,915, filed Jun. 12, 1992, and now abandoned.

FIELD OF THE INVENTION

The field of art to which the invention pertains comprises the art of support structures by which to hang relatively heavy units such as ceiling fans, light fixtures, etc. at a selected location beneath a drop or suspended ceiling.

BACKGROUND OF THE INVENTION

Ceiling fans typically represent a dynamic load of 25 pounds to 100 pounds. In new building construction or in existing building construction where wood joist or studs are completely exposed and readily accessible, providing additional structural support at the mounting site of a ceiling fan or a relatively heavy light fixture can be readily effected by well known forms of brackets, bracing, etc.. However, for ceiling mounting of these items in existing building structures without ready access to the studs or joists, installation becomes considerably more difficult if removal of the ceiling structure is to be avoided.

Where the ceiling is between floors of a multi-story structure, installation can prove particularly troublesome and for which it had been common to utilize a commercial form of interjoist hanger assembly. Installation of the hanger assembly typically involves transversely securing the hanger between the joists above a four inch ceiling opening provided at the mounting site.

BACKGROUND OF THE PRIOR ART

Various devices have been proposed for interjoist hanger support that can be installed through a four inch opening normally provided in a ceiling for an electrical outlet box. Exemplifying such devices are the disclosures of U.S. Pat. Nos. 2,140,861; 3,518,421; 4,405,111; 4,463,923; and my own prior patent 4,909,405. The latter patent is incorporated herein by reference.

The hanger devices of the foregoing patents are functionally dependent on attachments to spaced apart wood joists normally available as the basic support for a conventional ceiling. In the case of a drop or suspended ceiling, however the basic support therefor is typically provided by parallel metal members such as purlins, trusses, rails, etc. from which the lattice framework ceiling support structure is suspended. As a consequence, the former hanger devices are generally unsuitable and cannot be readily adapted for use with a drop or suspended ceiling.

A support hanger specifically intended for use with drop ceilings is commercially marketed under the trademark QUIK DROP. Comprising the latter are a pair of transversely intersecting bars which secure to the T-rails of the latticed framing that support the ceiling panels. An electrical outlet box is connected via a clip at the intersection of the bars. The box in turn, is locally supported from above by a wire connected between the clip and a predetermined section of wood stock installed in the vicinity as a false ceiling. The fan or other device to be hung is then secured flush at the underside of the drop ceiling by carriage bolts extending from beneath the electrical box.

OBJECTS OF THE INVENTION

It is an object of the invention to provide a novel hanger support for supporting a ceiling fan or other heavy object at the underside of a drop ceiling.

It is the further object of the invention to effect the previous object with a hanger support providing enhanced flexibility for positioning and assembling the hanger support at any selected ceiling location.

It is a still further object of the invention to effect the previous objects with a hanger support affording enhanced rigidity in resisting vibration and the dynamic load potentially imposed by a supported ceiling fan.

SUMMARY OF THE INVENTION

The invention relates to a novel hanger assembly for supporting a relatively heavy hanging load from the underside of a drop ceiling. More specifically, the invention relates to such an assembly suitable for supporting the dynamic load requirements of a ceiling fan at any selected site location on a drop ceiling.

By means of the hanger assembly structure hereof the unit can be readily installed by one workman. With the selected ceiling panel removed, access to the plenum is readily provided so as to enable installation.

The foregoing is achieved in accordance with the invention by a hanger assembly comprised of a pair of tubular bars adapted to intersect in a T formation. The head of the formation includes an elongated bar that spans the adjacently spaced T rails of the panel lattice framing and is mounted at both ends thereon. The center bar of the formation is secured at one end to one of the enclosing T rails of the lattice. Both bars can be relatively displaced for effecting their intersection at any desired superposed location within the dimensional limits of the ceiling panel. A bracket serves to secure both bars and a modified electrical junction box in a permanently rigid arrangement at the intersection site. Chain tautly looped or otherwise attached about the overhead building steel is secured so as to depend at the intersection site and by means of a turnbuckle is connected to the bracket. The turnbuckle can be utilized to effect micrometer adjustment in variably setting the height of the underlying junction box and/or setting the tension of the depending chain.

To directly support a fan there is provided a modified junction box secured as described supra with which their is provided optional styled load bolts to which the fan is to be attached. Each load bolt in pairs is caused to depend from a secured relation at the top of the box to depend downwardly through the ears for receipt of the fan connection. In one form, the bolt heads are flat and offset to their distal end where they are canted inward so as to bind onto a side surface of the junction box. In the alternative form, the bolts have a flat bolt head that includes a serrated annular shoulder at the underside along with an outward canted offset at the distal end of the head for locking onto the side of the junction box. The shoulder effects a force fit with the receiving box aperture at the top of the box. For either style, pushup and rotation of the bolts are resisted when the fan unit to be hung is being attached.

The features and advantages of the invention will be appreciated by those skilled in the art upon reading the detailed description which follows in conjunction with the drawings.

BRIEF DESCRIPTION OF THE DRAWINGS

FIG. 1 an isometric underside view of a ceiling fan mounted at the underside of a drop ceiling;

FIG. 6 is an isometric underside view of a first optional bolt structure for utilization herewith;

FIG. 7 is a fragmentary elevation view of a modified electrical outlet box utilizing the optional bolt of FIG. 6;

FIG. 8 is a fragmentary elevation view of a modified electrical box utilizing an alternative bolt structure.

DESCRIPTION OF THE PREFERRED EMBODIMENT

Figure 3:
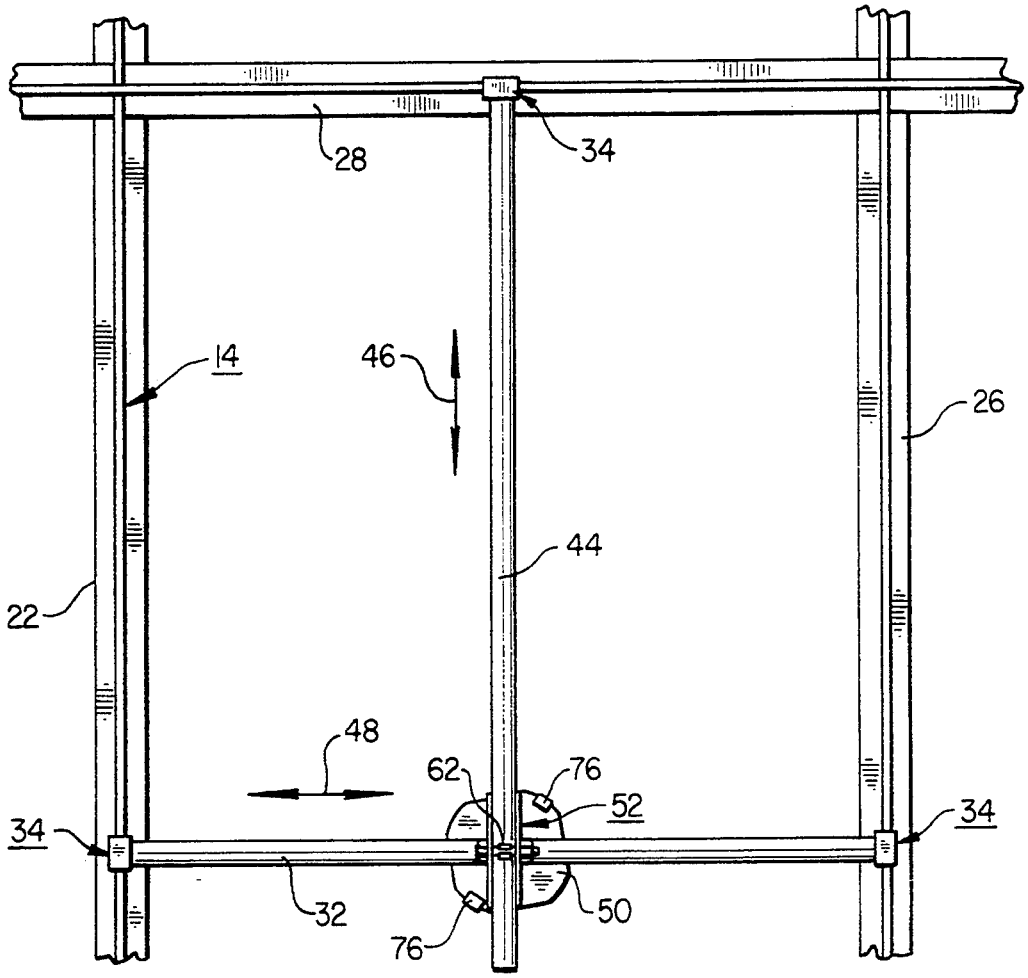
FIG. 3 is plan view as seen substantially along the lines 3—3 of FIG. 2.

In the description which follows, like parts are marked throughout the specification and drawings with the same reference numerals, respectively. The drawing figures are not necessarily to scale and the proportions of certain parts may have been exaggerated for purposes of clarity.

Figure 2:
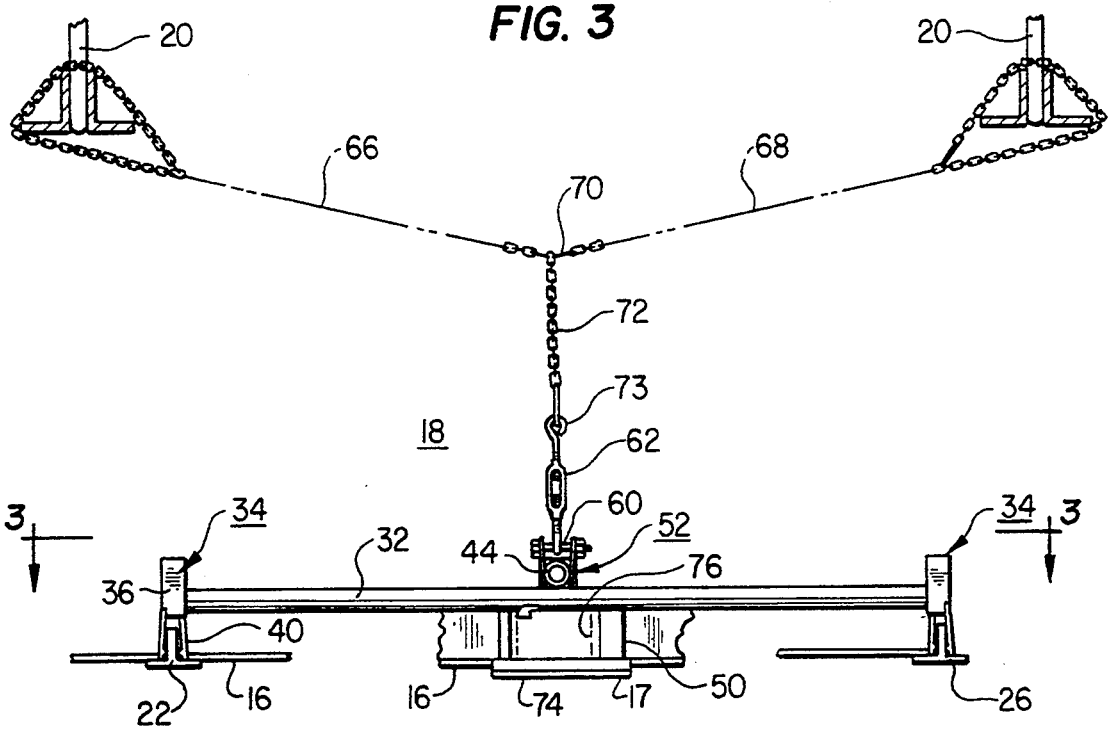
FIG. 2 is an elevation view of the installed hanger assembly hereof.
Figure 4:
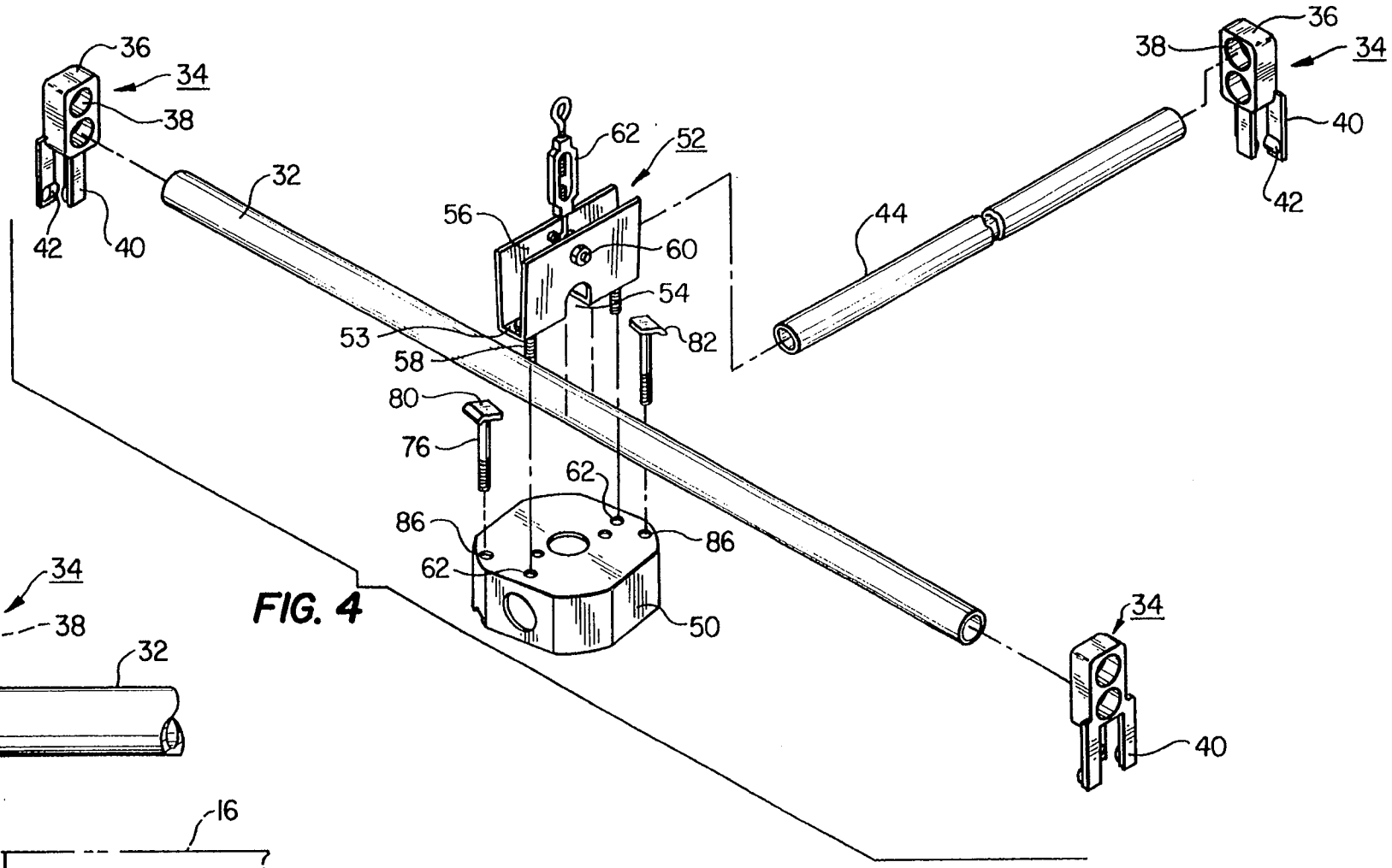
FIG. 4 is an isometric exploded view of the hanger components immediately above the ceiling panel.
Figure 5:
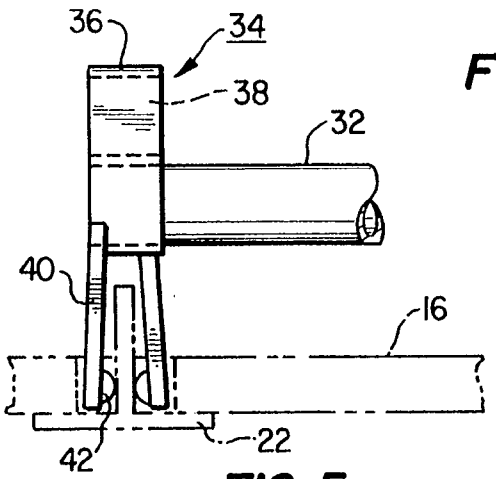
FIG. 5 is a fragmentary enlargement view of the bar end supports.

Referring now to FIGS. 1 and 2 of the drawings, there is illustrated a typical ceiling fan, designated 10, mounted to the underside of a drop ceiling 12 that includes the typical T rail lattice framework 14 by which each rectangular ceiling panel 16 is supported. As best seen in FIG. 2, the area above the ceiling includes a typical open plenum 18 in which steel trusses, purlins or whatever 20 extend and from which the lattice framework 14 is suspended. For clarity of discussion, the individual T rails of framework 14 surrounding a panel 16 are designated 22, 24, 26 and 28.

The hanger assembly hereof designated 30 will now be described more particularly with respect to FIG. 2–8. Comprising the hanger assembly is a first tubular cross bar 32 arranged transversely spanning the space between parallel T rails 22 and 26 and secured respectively thereto via individual foot mounts 34. Each foot mount is of a plastic composition that includes a body 36 containing vertically spaced transverse apertures 38. The lower apertures are utilized to receive the cross bar 32. At the underside of body 36 are three spring-like dependent legs 40 each of which includes an inwardly extending enlarged bead 42 at their distal ends. For attaching the foot mounts, the legs when spread are adapted to receive the upstanding horizontal flange of the T rails intervening therebetween and via the beads 42 impose a spring-grip thereon. Adapted to intersect bar 32 in an overlying relation is a second tubular bar 44 mounted similarly via a foot mount 34 to T rail 28.

It will be appreciated that the intersection location of the bars 32 and 44 for a selected site of a four inch opening 17 in panel 16. This is achieved by selectively positioning bar 32 in the direction 46 and selectively positioning the bar 44 in the direction 48. Once the site location has been determined, the bars 32, 44 along with the modified junction box 50 to be described infra are secured together in a permanent rigid arrangement via an inverted U-shaped saddle bracket 52.

The saddle bracket is comprised of relatively heavy gage sheet metal folded into a U-section so as to define a bottom wall 53 and a pair of side flanges 56. Contained in the bottom wall so as to extend up into the side flanges is a centrally located transverse recess in which to receive bar 32 while the open spacing between flanges 56 is sized to receive bar 44. At the underside of the bracket through bottom wall 53 are two spaced carriage bolts 58 normally held in place during installation of the assembly by spring nuts (not shown). Transversely connecting the two side flanges at a relatively upper location is a lateral bolt and companion nut 60. Mounted between the flanges on the bolt 60 is a turnbuckle 62 for reasons as will be described. It will be appreciated with this arrangement that with bar 32 received in recess 54 and bar 44 received within the fold of the flanges 56, each of the bolts 58 can be caused to extend through junction box apertures 64 where they are tightly secured internally from the underside via nuts (not shown). This has the effect of bracket 52 rigidly securing bar 32 to the top of junction box 50. By then, tightening bolt 60, the side flanges of the bracket are drawn together so as to rigidly clamp bar 44 whereby the entire assembly enables the anticipated dynamic loading and associated vibration to be imposed at the junction box to be readily withstood.

For the static load support there is utilized a pair of opposite elongated chains 66 and 68 each securely attached or looped about the parallel trusses 20 with their distal ends secured together above the bracket 52 via an S hook 70. Suspended from the S hook is a dependent chain 72 of a controlled length which at its free distal end is secured to the upper loop 73 of turnbuckle 62. By means of the turnbuckle, any unwanted slack in the chain can be readily removed so as to render the chain in a controlled tension with respect to bracket 52. It can be also utilized for any micrometer adjustment in height setting of the junction box relative to the plane of the ceiling 16.

In order to receive and support a fan support flange 74 normally provided by the fan manufacture, the provided bolts 76 or 78, as best seen in FIG. 6–8 are utilized to carry the load. As thereshown, load bolt 76 includes a flat head 80 extended to a canted offset 82 adapted at its underside to engage an edge of the junction box 50. Beneath the head is an annular serrated shoulder 84 for placement through apertures 86 at the top of the box located in axial alignment with apertures 88 in box ears 90. For these purposes, the diameter of shoulder 84 is slightly oversized with respect to the diameter of aperture 86 such that when the bolt 76 is inserted, the shoulder will effect a force fit within the aperture. In this manner, the flange 82 by engaging the side of the junction box prevents rotation of the load bolt while the shoulder 84 prevents upper displacement at such time as mounting flange 74 is being positioned onto the bolts and secured via nuts For similarly effecting resistance to both turning and upward displacement, alternative bolt 78 includes an offset flat head 94 that terminates in a reverse bend-back 96 having a corner 98 adapted to bind against the wall surface thereat of junction box 50. While the use of bolts 76 or 78 are generally preferred, they may in some instances be omitted such as where the fan manufacture supplies a special bracket of sorts to be utilized with the fans of their manufacture. Such special items may, for example, comprise a bracket secured internally against the upper wall of junction box 50 and can be secured by bolts extending through apertures 86.

It will be appreciated that installation of the hanger assembly hereof is relatively simple even for an unskilled workman. All components of the hanger assembly are pre-fabricated, in kit form and are basically manageable by hand with a minimal use of tools. The simplicity when handling minimizes the time of installation yet producing when assembled a hanger readily adapted to withstand the loading of an item to be suspended including the dynamic loading of a ceiling fan as might be attached thereto. The virtues thereof are many enabling a quick, relatively low cost installation to be achieved beneath a drop ceiling for which the use of ceiling fans has largely been ignored in the past.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. An unassembled hanger assembly, adapted when assembled for supporting a vertically hanging load at a selected site in the underside of a drop ceiling formed of a latticed rail framework suspended from overhead building structure and in which individual ceiling panels are disposed; said hanger assembly comprising in combination:

a first elongated bar to be secured to spaced apart rails of said framework spanning said site;

a second elongated bar to be secured to a rail of said framework and to extend normal to said first bar intersecting said first bar at said site;

a load box to be located beneath the intersection of said first and second bars overlying said site;

a bracket including securement means effective to secure said first elongated bar and said box at said intersection in a relatively rigid vibration resistant clamping relation therebetween and effective further to secure said second elongated bar in a rigid compressive relation to said bracket;

suspension means for supporting said bracket from said building structure from above the vicinity of said site and having a centrally arranged dependent portion attached to said bracket in a taut support relation therewith; and attachment means on said box for receiving a load attachment of a load to be hung.

2. A hanger assembly in accordance with claim 1 including micrometer adjusting means connected between the distal end of the dependent portion of said suspension means and said bracket to enable presetting the tension level of said dependent portion.

3. A hanger assembly in accordance with claim 1 in which said bracket is of an inverted U-shape configuration with a bottom wall having a centrally located transverse recess through which to receive the first of said elongated bars, and said securement means includes spaced apertures in the bottom wall at each side of said recess in which to contain bolts for attaching the bracket to said box whereby to sandwich said first elongated bar securely intervening between the bottom wall recess and said box.

4. A hanger assembly in accordance with claim 3 in which said bracket includes spaced apart side flanges upstanding from said bottom wall and the second of said elongated bars is received in said bracket disposed between the flanges thereof and said securement means includes bolt means extending transversely through said flanges enabling said flanges to be drawn together for affecting a secured relation with respect to said second elongated bar disposed therebetween.

5. A hanger assembly in accordance with claim 1 in which said attachment means comprises a pair of spaced load bolts extending dependingly through said load box from through apertures in the top wall of said load box and said bolts include formation means integrally disposed thereon and adapted to cooperate with said load box for resisting both upward and rotational displacement of the bolt.

6. A hanger assembly in accordance with claim 5 in which said load box comprises an electrical junction box including inwardly extending ears oppositely located at the underside open face thereof and the load to be hung comprises a ceiling fan.

7. A hanger assembly in accordance with claim 6 in which each of said top wall apertures is in vertical coaxial alignment with an aperture in an ear of said junction box and each of said bolts depend from through a top wall aperture to through an ear aperture.

8. A hanger assembly in accordance with claim 7 in which said bolts have flat heads with downwardly canted portions at a distal end thereof to engage against a side surface of said junction box for effecting said resistance to rotation.

9. A hanger assembly in accordance with claim 8 in which said bolts include a serrated shoulder at the underside of the bolt head for effecting a force fit relation within said top wall aperture that effects said resistance to upward displacement.

10. A hanger assembly in accordance with claim 8 in which the distal end of said bolt head includes a bent portion extending toward the bolt shank so as to bind against a side surface of said junction box and effect said resistance to displacement.

11. A hanger assembly in accordance with claim 1 in which said first and second bars when installed are relatively displaceble to said site and are secured together by said bracket so as to maintain their intersection at said selected site.

12. A support box assembly for receiving a load to be attached and comprising:

an electrical junction box having a pair of spaced apertures through the top wall from which support bolts are to depend internally of the box; and load bearing bolts having a head disposed on one end thereof adjacent said top wall, said bolts extending through said apertures and from which a load is to be secured at the distal end thereof and comprising formation means disposed integrally about said head and adapted to cooperate with said junction box for resisting both upward and rotational displacement of the bolt.

13. A support box assembly in accordance with claim 12 in which said bolts have flat heads downwardly canted at their distal end to engage against a side surface of said junction box for effecting said resistance to rotation.

14. A support box assembly in accordance with claim 13 in which said bolts include a serrated shoulder at the underside of the bolt head for effecting a force fit relation within said top wall aperture that effects said resistance to upward displacement.

15. A support box assembly in accordance with claim 13 in which said top wall apertures are in coaxial alignment with apertures in the ears of said junction box and said bolt depends through both the top wall and ear apertures of said junction box.

16. A support box assembly in accordance with claim 13 in which the distal end of said bolt head is bent back toward the bolt shank so as to bind against a side surface of said junction box in effecting said resistance to upward displacement.

17. A hanger assembly for supporting a vertically hanging load at a selected site in the underside of a drop ceiling formed of a latticed rail framework suspended from overhead building structure and in which individual ceiling panels are disposed; said hanger assembly comprising in combination:

a first elongated bar secured to spaced apart rails of said framework spanning said site;

a second elongated bar secured to a rail of said framework and extending normal to said first bar intersecting said first bar at said site;

a load box located beneath the intersection of said first and second bars overlying said site;

a bracket including securement means securing said first elongated bar and said box at said intersection in a relatively rigid vibration resistant clamping relation therebetween and securing said second elongated bar in a rigid compressive relation to said bracket;

suspension means supporting said bracket from said building structure from above the vicinity of said site and having a centrally arranged dependent portion attached to said bracket in a taut support relation therewith; and attachment means on said box for receiving a load attachment of a load to be hung.

18. A hanger assembly in accordance with claim 17 in which said bracket is of an inverted U-shape configuration including a bottom wall having a centrally located transverse recess through which to receive the first of said elongated bars, and said securement means includes spaced apertures in the bottom wall at each side of said recess and bolts in said apertures attaching the bracket to said box whereby to sandwich said first elongated bar securely intervening between the bottom wall recess and said box.

19. A hanger assembly in accordance with claim 18 in which said bracket includes spaced apart side flanges upstanding from said bottom wall and the second of said elongated bars is received in said bracket disposed between the side flanges thereof and said securement means includes bolt means extending transversely through side flanges drawing said flanges together in effecting a secured relation with respect to said second elongated bar disposed therebetween.

20. A hanger assembly in accordance with claim 17 in which said attachment means comprises a pair of spaced load bolts extending dependingly through said load box from through apertures in the top wall of said load box and said bolts include formation means integrally disposed thereon and cooperating with said load box for resisting both upward and rotational displacement of the bolt.

* * * * *